United States Patent [19]

Johnston, Jr.

[11] 4,229,854

[45] Oct. 28, 1980

[54] SOOT BLOWER CONSTRUCTION

[75] Inventor: Jesse C. Johnston, Jr., Carroll, Ohio

[73] Assignee: The Babcock & Wilcox Company, New Orleans, La.

[21] Appl. No.: 949,089

[22] Filed: Oct. 6, 1978

[51] Int. Cl.[3] ..... F23J 3/02

[52] U.S. Cl. ..... 15/316 R

[58] Field of Search ..... 15/312 R, 316 R, 316 A, 15/317, 318

[56] References Cited

U.S. PATENT DOCUMENTS

| | | | |
|---|---|---|---|
| 3,216,045 | 11/1965 | McColl | 15/317 |
| 3,216,046 | 11/1965 | Chappell | 15/317 |
| 3,230,568 | 1/1966 | Saltz | 15/317 |
| 3,439,376 | 4/1969 | Nelson et al. . | |
| 3,604,050 | 9/1971 | Nelson et al. | 15/317 |

*Primary Examiner*—Christopher K. Moore
*Attorney, Agent, or Firm*—Harness, Dickey & Pierce

[57] ABSTRACT

A soot blower of the long retracting type includes a box beam within which a lance tube is longitudinally movable by means of a carriage suspended on rollers to travel along an integrated rack/track assembly secured to the inner walls of the box beam. Such rack/track assemblies have longitudinal rails on their tops for the rollers and longitudinal racks secured to the bottoms of the rails. The racks are engaged by underlying walking pinions journaled in the carriage and positioned directly beneath the rollers. In a modification, the combined rack/track assemblies include bottom rail surfaces in addition to top rail portions, and bottom rollers are employed in addition to the pinions and top rollers. In another modification, the carriage is supported by an I-beam the bottom flanges of which constitute the tracks, a single rack being secured to the underside of such bottom flange.

The carriage has a set of accessible spur gears journaled at its rear wall beneath a cover, including a driving gear keyed slidably on a shaft driven by a stationary motor at the rear of the beam, the gear set being connected by a shaft which projects into the carriage to internal gears in the carriage which drive the walking pinions, one of the accessible rear gears being drivingly connected to the lance tube to rotate the latter as the lance tube is moved longitudinally by the carriage.

4 Claims, 8 Drawing Figures

SOOT BLOWER CONSTRUCTION

BACKGROUND OF THE INVENTION

In the construction of long retracting soot blowers of the longer travels required by the increasing size of large public utility boilers it has become necessary to extend the lance tube in cantilever fashion into the boiler for distances of forty to fifty or fifty-five feet. The forces resulting not only from the weight of the lance tube and carriage but from the overhung situation which exists when the lance tube is projected creates severe problems due to the high stresses applied to all of the supporting and guiding components. A commercially successful soot blower designed for travels of as much as forty-five feet is disclosed in U.S. Pat. No. 3,439,376, granted Apr. 22, 1969 to John E. Nelson and John R. Saltz. In the Nelson-Saltz construction the carriage to which the lance tube is connected and by which it is actuated is supported and guided by and between the internal walls of a box beam by means of rollers each of which travels between a pair of upper and lower tracks which are spaced apart a distance conforming to the diameter of the rollers. When the lance tube is retracted far enough so that the system is not overbalanced by the portion of the lance tube remaining in the boiler, the rollers bear against the bottom tracks, while when the load is overbalanced, the rollers bear against and roll along the undersides of the upper tracks. It will be recognized that the resultant vertical forces tend to separate the tracks and impose loadings which tend to spread the tracks and the walls of the box beam. It will be appreciated also by those familiar with the construction and operation of soot blowers that when a long lance is projected into the boiler, great power is required to drive it longitudinally, particularly in the retracting direction since the pressure of the blowing medium opposes retraction and adds to the unavoidably high frictional resistance. Because of the angulation or curvature of rack and pinion gear teeth, the forces generated therebetween in driving the lance do not act along a line parallel to the direction of movement of the lance but rather at some angle relative to the desired direction of movement. Thus, these driving forces produce movement generating force components acting parallel to the direction of movement and cam action components acting in a direction perpendicular to the direction of movement. These cam action forces act in a direction tending to separate the rack and pinion elements and may become very high particularly during retraction. Thus, the resulting reaction forces, with prior constructions, have created a rocking couple or moment about a longitudinal axis tending to distort and damage the structure. Problems have resulted due to such stresses under the severe loadings imposed by conditions encountered with long travel blowers. In addition it has been necessary to employ very heavy construction to withstand such forces. An important object of the present invention is to provide improved supporting and guiding means wherein the vertical forces resulting from the cam-like reaction between rack and pinion drive means offset each other without imposing stresses which might distort either the track portions or the beam structure.

A related object is to provide such an assembly wherein the loading problems are further relieved by the fact that the structure is lighter in weight in proportion to its strength and stiffness.

A further related object is to provide such a structure which is lower in cost.

Another object of the invention is to provide an improved carriage driving system.

Other objects and advantages will become apparent to persons skilled in the art upon consideration of the present disclosure in its entirety.

BRIEF DESCRIPTION OF THE FIGURES OF DRAWING

FIG. 3 is a horizontal sectional view on a larger scale and partly broken away, taken directly beneath the top wall of the beam and showing the principal components in plan;

DETAILED DESCRIPTION OF PREFERRED FORM OF THE INVENTION

Figure 1:
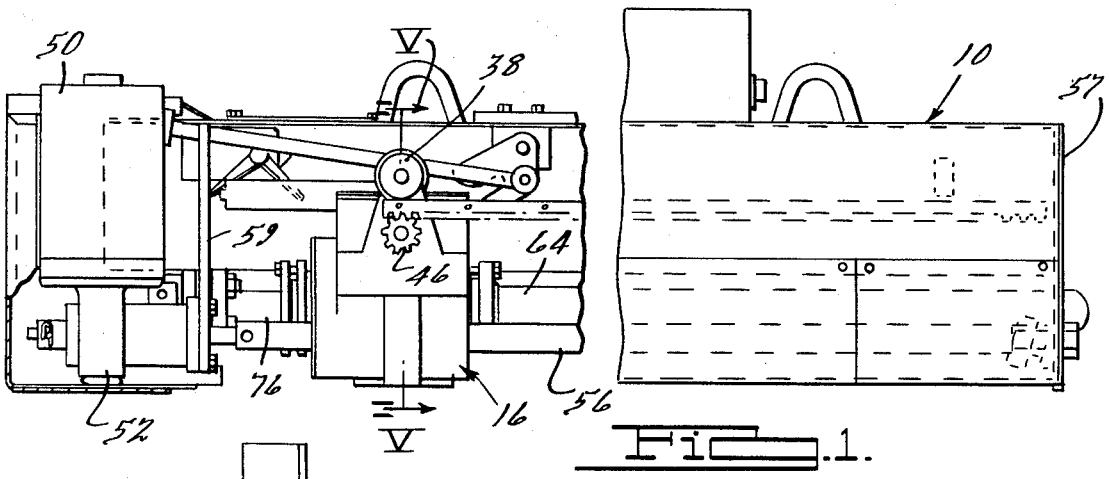
FIG. 1 is a side elevational view, centrally broken away, of a long travel soot blower incorporating the principles of the present invention.
Figure 2:
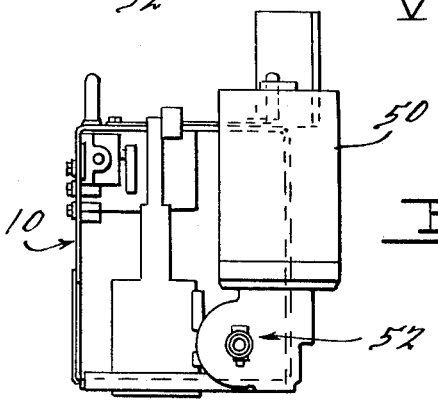
FIG. 2 is a rear elevation.
Figure 4:
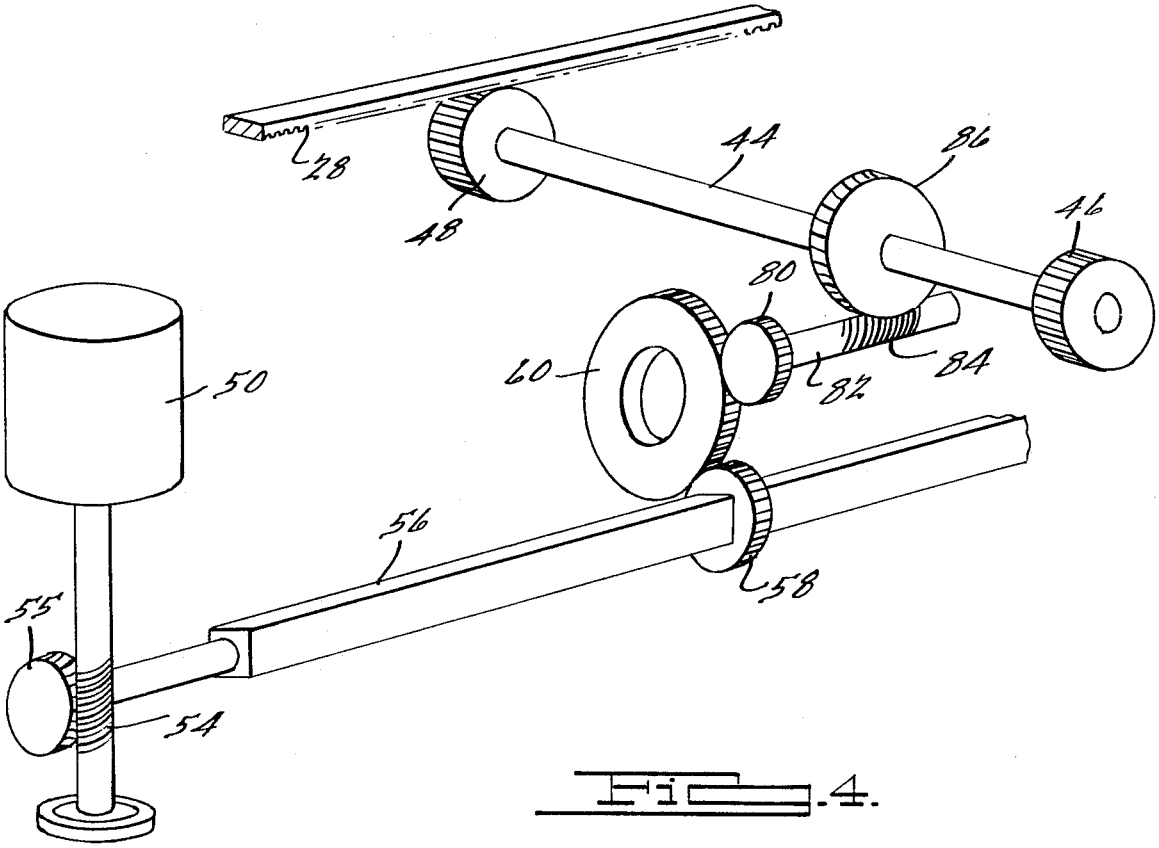
FIG. 4 is a diagrammatic perspective view of the principal gearing components.
Figure 2:
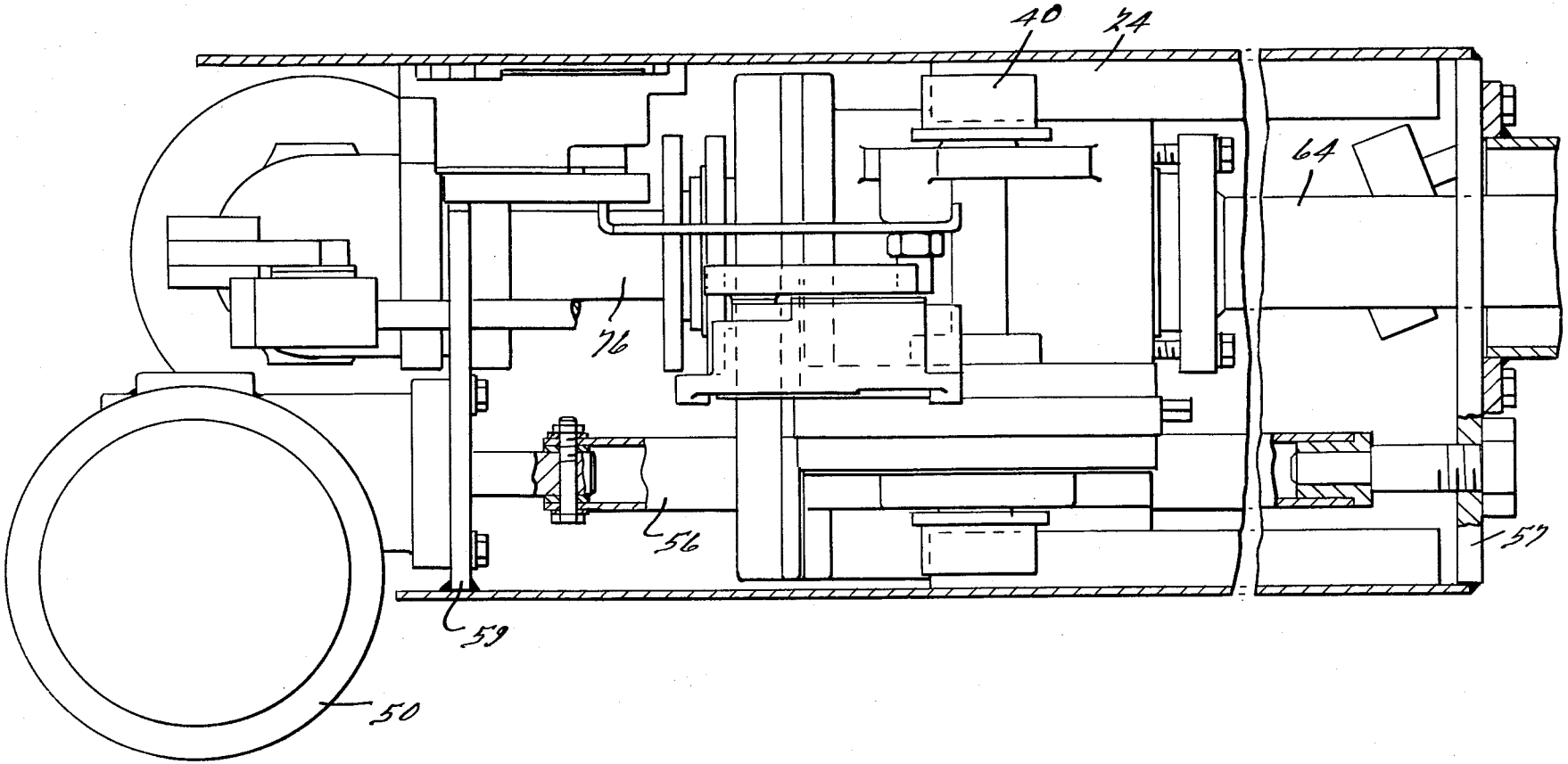
Figure 5:
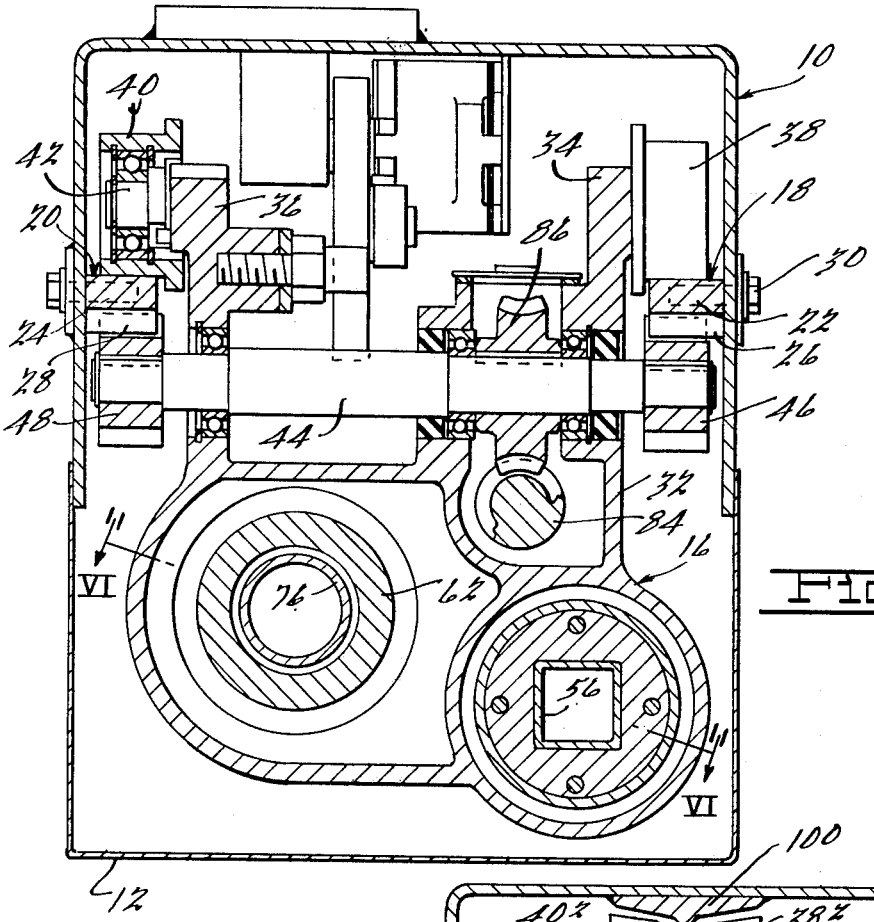
FIG. 5 is a cross-sectional view on a larger scale taken substantially on the line V—V of FIG. 1 and looking in the direction of the arrows.

Reference character 10 designates generally an inverted U-channel formed of heavy sheet metal which constitutes the main frame of the soot blower and which is adapted to be mounted appurtenant to a boiler setting (not shown) by a suitable supporting structure (not shown), as is well known in the art. The box beam enclosure is completed by a bottom cover U-channel 12. A carriage generally designated 16 is supported to travel longitudinally in the beam on a pair of rigidly integrated longitudinal rack and track structures, one such structure, generally designated 18 being attached to and projecting inwardly from one side wall of channel 10, shown at the right in FIG. 5, and a similar integrated rack/track structure 20 being attached to the other side wall in horizontally aligned relation. Each integrated rack/track structure includes a top rail portion 22, 24 having a smooth top surface, and a rack portion 26, 28 rigidly attached as by welding to the bottom of the rail and having depending teeth. The integrated rack/track structures are rigidly attached to the respective walls of the U-channel throughout the effective length of travel, as by welding and lag screws 30 extending through the walls and into the rail portions.

The carriage includes a rigid cast frame 32 having integral hanger bracket portions 34, 36 which extend upwardly relatively close to and somewhat above the integrated rack/track structures. Supporting rollers 38 and 40 journaled coaxially on heavy stub shafts as 42 carried by the brackets 34, 36 overlie and are rollable on the respective rails 22, 24. A transverse shaft 44 is journaled in the carriage frame spacedly beneath and in vertical alignment with the rollers 38, 40. The ends of shaft 44 extend beneath the rack portions 26, 28 and carry walking drive pinions 46, 48 which mesh with rack portions 26, 28 respectively.

Figure 6:
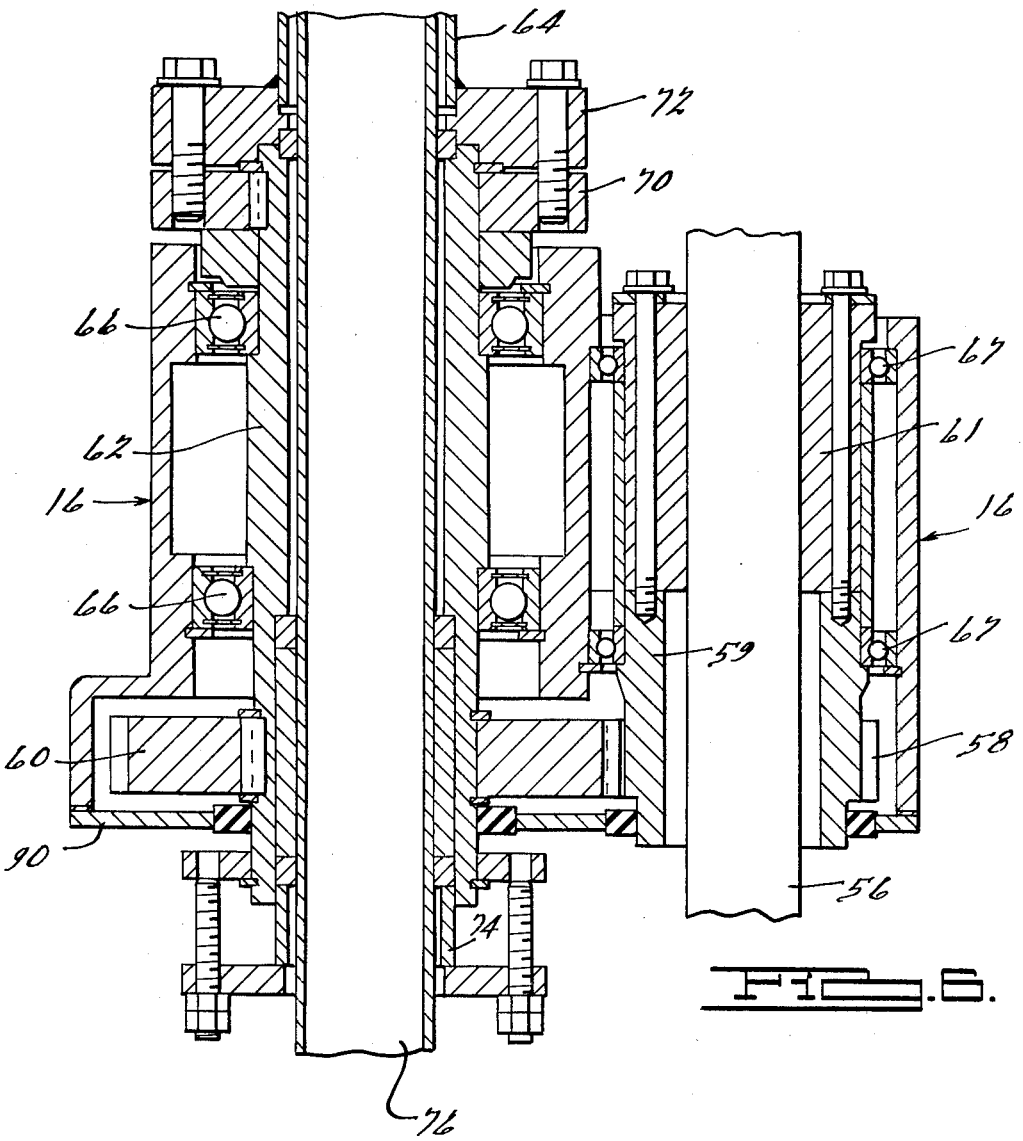
FIG. 6 is a cross-sectional view taken substantially on the line VI—VI of FIG. 5 and looking in the direction of the arrows.

The pinions 46, 48 are driven, to move the carriage and lance tube longitudinally, by power derived from a motor 50 fixedly supported by and at the rear end of the beam 10. The motor drives, through a gear assembly generally designated 52 and which includes a worm 54 and worm wheel 55, a squared shaft 56 rotatably supported by and between the front and rear bulkheads 57, 59. A gear 58 journaled in the carriage 16 is slidably keyed to the shaft 56 and meshes with a gear 60, also journaled in the carriage and which is keyed to a sleeve 62 journaled in the carriage, to which the lance tube 64 is secured in such manner as to be rotated and longitudinally driven during movement of the carriage. As shown in FIG. 6, gear 58 is formed integrally with an axially elongated hub portion 59 fastened to an extension hub section 61 having a square opening therein fitted slidably on square shaft 56. The hub assembly and gear 58 are journaled in the carriage by means of antifriction bearings 67. Gear 60 is keyed to the lance hub sleeve 62, which is mounted in the carriage frame 16 in suitable bearings 66 and at its forward end carries fast thereon a flange 70 to which is bolted the flange 72 attached to the rear end of the lance tube. A suitable packing gland generally designated 74 provides a seal between the sleeve 62 and the stationary feed tube 76. Feed tube 76 projects through the sleeve and into the lance tube 64, the sleeve and lance tube being slidably overfitted on the feed tube, as is conventional.

Gear 60 is also meshed with a gear 80 fast on a shaft 82 extending forwardly in the carriage and carrying a worm 84 meshing with a worm wheel 86 fast on the shaft 44.

It is believed that the operation of the system will be apparent from the description given. When the shaft 56 is rotated by the motor 50 the gear 58, which is mounted in the carriage to travel therewith, rotates the gear 60, thereby rotating the lance tube about its axis, and at the same time drives the walking pinions 46, 48 which move the carriage along the rails to project and retract the lance tube. The gears 58, 60 and 80 are located at the rear of the carriage and are accessible by removing the rear carriage cover 90.

Figure 7:
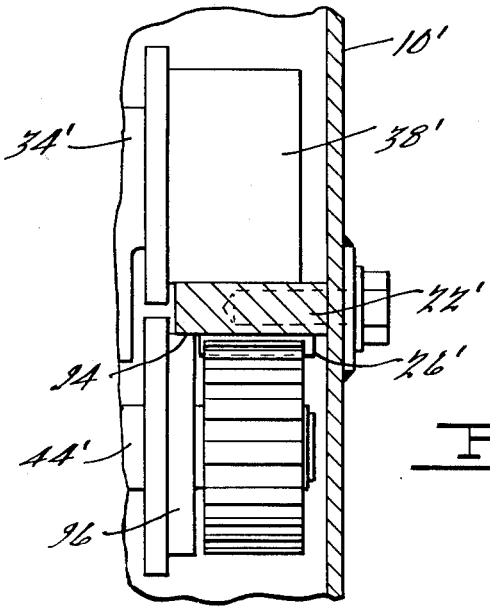
FIG. 7 is a fragmentary sectional vertical elevational view showing a modification.

FIG. 7 shows a modified construction designed for extremely heavy service. Parts corresponding to parts already described are designated by like reference numerals primed. The track portions as 22' are widened, and the rack portions as 26' do not occupy the full width of the underside of the track portions. (Although only one side is illustrated, it will be understood that the unillustrated side is of conforming construction, corresponding in other respects to the showing of FIG. 5.) Track portion 22' has a smooth portion 94 of its bottom surface projecting inwardly toward the center of the beam beyond the rack portion 26' to define a bottom rail surface. Hanger portion 34' which corresponds to hanger portion 34 of the first described embodiment carries in addition to a top roller 38' corresponding to the roller 38, a bottom roller 96 journaled on shaft 44' and rollable upon the bottom rail surface 94. Rollers corresponding to the rollers 38' and 96 are of course employed at the other side of the assembly. The bottom rollers corresponding to the roller 96 maintain the walking pinions at the proper pitch distance with respect to the teeth of the racks, and take the upward vertical forces when the lance is in the overbalanced condition.

Figure 8:
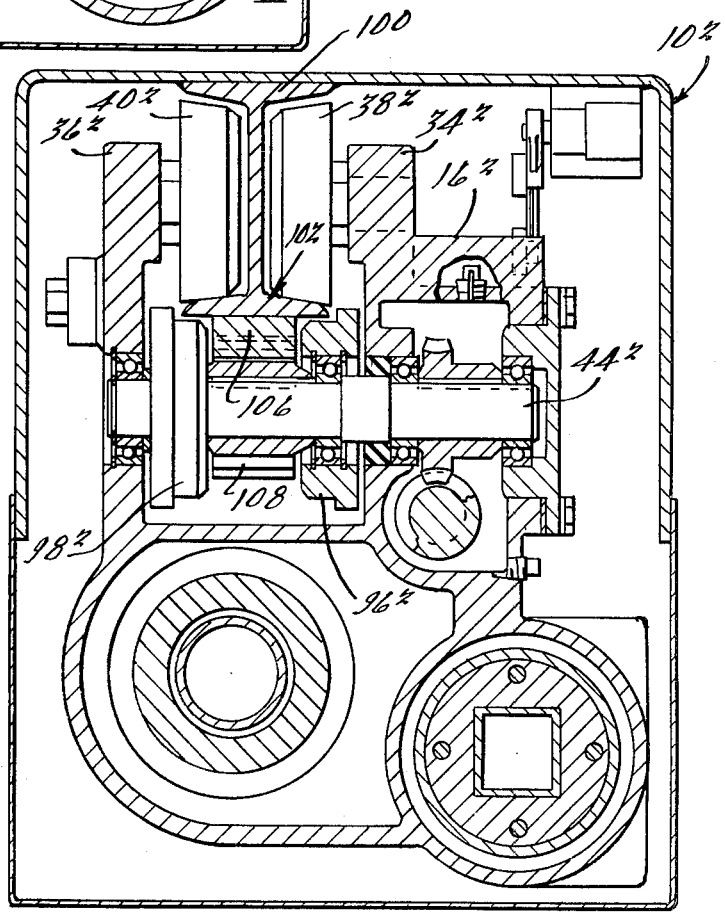
FIG. 8 is a view corresponding to FIG. 5, showing another modified construction.

In the further modified construction shown in FIG. 8, wherein parts corresponding to parts already described are designated by like reference numerals squared, a longitudinal I-beam generally designated 100 defines the track means for supporting the carriage in the box beam $10^2$. I-beam 100 is secured as by welding to the underside of the flat top flange of the box beam. The carriage $16^2$ has a pair of hanger bracket portions $34^2$, $36^2$ carrying aligned stub shafts (undesignated) which project inwardly toward the central web of the I-beam 100, each subshaft carrying journaled thereon a roller as $38^2$, $40^2$ rollable along the top surfaces of the bottom flange 102 of the I-beam, which surfaces define rail portions corresponding to the top surfaces of track portions 22, 24. A single rack 106 is secured as by welding to the bottom surface of the flange 102. Rack 106 is narrower than the flange 102, and the bottom surfaces of the portions of flange 102 which project laterally from the rack define bottom rail surfaces corresponding to the surface 94 of the embodiment described in connection with FIG. 7. Bottom rollers $96^2$, $98^2$ journaled on the shaft $44^2$ underlie the projecting portions of bottom flange 102 and are rollable therealong in the overbalanced condition. A single pinion 108 fast on shaft $44^2$ is driven in a manner similar to the mechanism previously described to actuate the carriage and lance longitudinally.

While preferred embodiments of the invention have been described herein, it will be appreciated that various modifications and changes may be made without departing from the spirit and scope of the appended claims.

This description of the preferred embodiments, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. In a long retracting soot blower or the like comprising a frame structure including a generally horizontal elongated support, a lance carried by the support for movement generally parallel thereto to and from positions in which an end of the lance projects differing distances beyond the end of the support, and combined means for so moving the lance and for transmitting vertical loadings from the lance to said support, said combined means including a carriage to which the lance is attached, the carriage being movably carried by the support to actuate the lance, said carriage having a rigid frame, a carriage driving pinion journaled in the carriage on a transverse axis, and a roller also journaled in the carriage frame on a transverse axis vertically displaced from the first mentioned transverse axis, said combined means also including a rigidly integrated longitudinal rack and track structure carried by the support including a track portion having a generally horizontal longitudinal track surface and a rack portion having a generally horizontal longitudinal toothed surface, said surfaces facing away from each other in opposite vertical directions, said combined means being characterized in that the track surface and the toothed surface overlap each other when viewed in a vertical projection, the pinion meshing with said toothed surface and the roller being rollable on said track surface, and the axes of the roller and pinion being rigidly fixed in the carriage frame on parallel lines transverse to the longitudinal extent of said rack and track structure, the line of engagement of the roller directly overlying the position of meshing engagement between the pinion and toothed surface, whereby the rack and track structure is confined between the pinion and roller and vertical forces are transmitted in opposite directions via the carriage frame and the roller and pinion into the integrated rack and track structure.

2. A long retracting blower as defined in claim 1 wherein said combined means includes at least two such integrated rack and track structures laterally spaced from each other and secured to said support in parallel relation, a pair of such pinions aligned with each other on an axis transverse to the rack and track structures, one of which pinions is in meshing engagement with the toothed surface of each rack portion, and a pair of such rollers, one of which is rollable on the track surface of each rack and track structure.

3. A long retracting blower as defined in claim 2 wherein the frame structure comprises a hollow beam having a pair of vertical side flanges, each of said flanges defining one of said supports, said integrated rack and track structures being secured to the inwardly facing walls of said flanges.

4. A long retracting blower as defined in either of claims 1 or 2 wherein each track surface faces upwardly and the teeth of each toothed surface project downwardly.

* * * * *

Disclaimer 4,229,854.—*Jesse C. Johnston, Jr.,* Carroll, Ohio. SOOT BLOWER CONSTRUCTION. Patent dated Oct. 28, 1980. Disclaimer filed Sept. 1, 1983, by the assignee, *The Babcock & Wilcox Co.*

Hereby enters this disclaimer to claims 1 and 4 of said patent.

[*Official Gazette October 25, 1983.*]